US007841690B2

(12) United States Patent
Ogawa

(10) Patent No.: US 7,841,690 B2
(45) Date of Patent: Nov. 30, 2010

(54) IMAGE RECORDING APPARATUS

(75) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 912 days.

(21) Appl. No.: 11/668,767

(22) Filed: Jan. 30, 2007

(65) Prior Publication Data

US 2007/0176962 A1 Aug. 2, 2007

(30) Foreign Application Priority Data

Jan. 31, 2006 (JP) ..... 2006-021843

(51) Int. Cl.
*B41J 2/165* (2006.01)

(52) U.S. Cl. ..... 347/29; 347/30

(58) Field of Classification Search ..... 347/29–30
See application file for complete search history.

(56) References Cited

U.S. PATENT DOCUMENTS

| | | | | |
|---|---|---|---|---|
| 5,166,707 | A | 11/1992 | Watanabe et al. | |
| 5,471,230 | A | 11/1995 | Saito et al. | |
| 5,481,283 | A | 1/1996 | Watanabe et al. | |
| 5,481,290 | A | 1/1996 | Watanabe et al. | |
| 6,793,317 | B2 * | 9/2004 | Shima | 347/29 |
| 6,918,650 | B2 | 7/2005 | Umeda et al. | |
| 7,244,013 | B2 * | 7/2007 | Harada et al. | 347/29 |
| 7,562,959 | B2 * | 7/2009 | Suzuki | 347/29 |

FOREIGN PATENT DOCUMENTS

| | | | |
|---|---|---|---|
| JP | 3234644 | A | 10/1991 |
| JP | 414461 | A | 1/1992 |
| JP | 8332732 | A | 12/1996 |
| JP | 08332732 | A * | 12/1996 |
| JP | 970979 | A | 3/1997 |
| JP | 1034944 | A | 2/1998 |
| JP | 200196758 | A | 4/2001 |
| JP | 2004058417 | A | 2/2004 |

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

An image recording apparatus includes a recording head and a capping unit which seals a nozzle forming face of the recording head and sucks the ink from the nozzles. The capping unit includes a cap member having a plurality of housing recesses partitioned from each other for ink suction from a corresponding one of a plurality of groups of the nozzles, and cap chips housed in the respective housing recesses. The cap member includes discharge ports discharging the ink sucked into the respective housing recesses, a peripheral rib positioned at an outer peripheral portion enclosing all of the housing recesses, and a partitioning rib defining the housing recesses, two end portions of the partitioning rib being connected to the peripheral rib. The cap chips include regulating portions which abut against side faces of the partitioning rib to suppress deformation of the partitioning rib in a direction crossing the side faces.

10 Claims, 14 Drawing Sheets

IMAGE RECORDING APPARATUS

CROSS-REFERENCE TO RELATED APPLICATION

This application claims priority from Japanese Patent Application No. 2006-021843, filed on Jan. 31, 2006, the entire subject matter of which is incorporated herein by reference.

TECHNICAL FIELD

Aspects of the present invention relate to an ink-jet type image recording apparatus for recording an image on a recording medium by discharging ink from a nozzle.

BACKGROUND

There has been an image recording apparatus for recording an image by reciprocating a carriage, which has an ink-jet head (or a recording head) for recording the image on the recording medium by discharging the ink from the nozzles, in a direction perpendicular to the carrying direction of the recording medium. In this ink-jet type image recording apparatus, maintenance operations such as sucking and removing air bubbles reserved in the recording head or dried and solidified ink in the nozzles is carried out. For these operations, a maintenance unit of the image recording apparatus is usually provided outside of a recording area, in which the recording head (or the carriage) is moved relative to the recording medium, and in the vicinity of the moving ends of the recording head (or the carriage)

The maintenance unit has a cap member, which is brought to and away from a nozzle forming face. When the recording head goes out of the recording area to the position of the cap member, the cap member comes into close contact with the nozzle forming face, and suction operation or the like is performed by a suction pump connected to the cap member.

JP-A-3-234644 discloses a configuration in which a cap member made of a flexible rubbery elastomer has a recess corresponding to the openings of a plurality of nozzles and a projection portion (or an outer peripheral rib portion) enclosing the outer periphery of the recess and projecting toward the nozzle forming face. At the maintenance operation time, the projection portion comes into close contact with the nozzle forming face and encloses the openings of the nozzles.

However, the projection portion (or the outer peripheral rib) may have fallen and deformed into the recess due to the action of a vacuum pressure on the recess. In this case, the contact of the cap member with the nozzle forming face is extremely degraded. Thus, the maintenance operations of the recording head cannot be reliably performed.

JP-A-10-34944 discloses a configuration in which a ring-shaped reinforcement member is buried in the recess to abut against the inner peripheral wall of the recess. The reinforce member is made of a more rigid member than the cap member. Therefore, the projection portion (or the outer peripheral rib portion) is hard to fall and deform toward the recess even when a vacuum pressure acts in the recess.

SUMMARY

In color image recording, ink-jet heads to be mounted store a plurality of color ink (e.g., yellow ink, magenta ink and cyan ink), and they can discharge ink of different colors from corresponding nozzle rows each having a plurality of nozzles.

Thus, it is conceivable to provide a straight partition rib at a portion that defines a first recess for sucking the black ink and a second recess for sucking the plural kinds of color ink in the cap member. The partition rib in this case is generally made to have a smaller sectional area than that of the outer peripheral projection (or the outer peripheral rib).

When such projection and partition rib of the cap member are held in close contact with the nozzle forming face, the less rigid (or more deflectable) partition rib is liable to be earlier deflected or deformed.

Further, when the vacuum pressure acts on only the recess on one side, the partition rib is transversely pushed by the air pressure coming from the recess under higher pressure. Moreover, the ink may be sucked from the nozzles at untargetted portions.

Aspects of the invention provide an image recording apparatus, which is enabled by a simple constitution to suppress the transverse fall of the outer peripheral rib and the partitioning rib thereby to ensure the ink sucking operation for each group of nozzles and to perform the recovery works (or the maintenance works) promptly.

DETAILED DESCRIPTION

<General Overview>

According to an aspect of the invention, an image recording apparatus comprises: a recording head having a plurality of nozzles which eject ink; and a capping unit which seals a nozzle forming face of the recording head and sucks the ink from the nozzles, wherein the capping unit includes: a cap member having a plurality of housing recesses which are partitioned from each other for ink suction from a corresponding one of a plurality of groups of the nozzles; and cap chips housed in the respective housing recesses, wherein the cap member includes: discharge ports which discharge the ink sucked into the respective housing recesses; a peripheral rib which is positioned at an outer peripheral portion enclosing all of the housing recesses; and a partitioning rib defining the housing recesses, two end portions of the partitioning rib being connected to the peripheral rib, and wherein the cap chips include regulating portions which abut against side faces of the partitioning rib to suppress deformation of the partitioning rib in a direction crossing the side faces.

According to another aspect of the invention, an image recording apparatus comprises: a recording head having a plurality of nozzles which eject ink; and a capping unit which seals the nozzle forming face of the recording head and sucks the ink from the nozzles, wherein the capping unit includes: a cap member having a housing recess which collectively sucks the ink from a plurality of groups of the nozzles; and a cap chip housed in the housing recess; wherein the cap member includes: a discharge port which discharges the ink sucked into the housing recess, and a peripheral rib which is positioned at an outer peripheral portion enclosing the housing recess; and wherein the cap chip includes a regulating portion which abuts against a side face of the peripheral rib and which suppresses deformation of the peripheral rib in a direction crossing the side face.

<Illustrative Aspects>

Illustrative aspects of the invention are described as follows with reference to the accompanying drawings.

Figure 1:
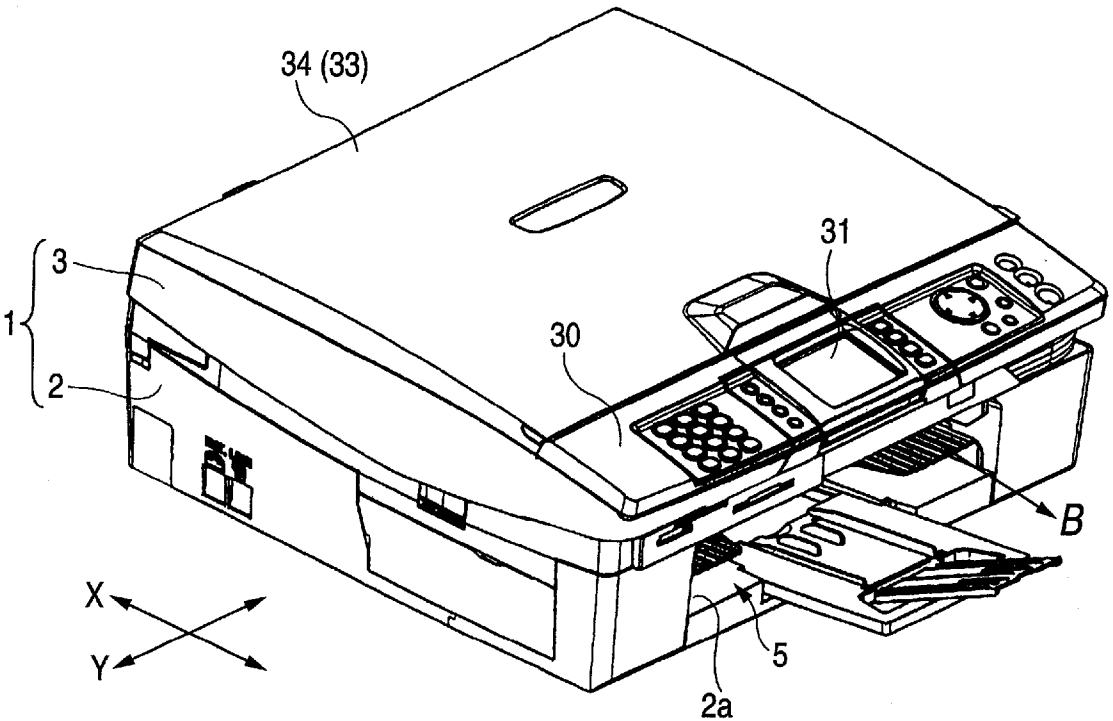
FIG. 1 is a perspective view of an image recording apparatus.

The multi-function type image recording apparatus 1 shown in FIG. 1 comprises a facsimile function, a printer function, a copy function, a scanner function and so on. The multi-function type image recording apparatus 1 includes a substantially box-shaped main unit case 2, a top face of which is opened, and an upper case 3 pivotally connected to one side (i.e., left side in FIG. 1) of the main unit case 2 through a turning pin (not shown) such as a hinge being capable of turning up and down. Here, the following description is made by locating the near side on the right side of the image recording apparatus 1 of FIG. 1 as the front side and by defining the transverse direction (i.e., the main scanning direction or the Y-axis direction), the longitudinal direction (i.e., the auxiliary scanning direction or the X-axis direction) and the vertical direction with reference to the direction of the image recording apparatus 1 of FIG. 1. The main unit case 2 and the upper case 3 are injection moldings of a synthetic resin.

An operation panel 30 is provided on the front portion of the upper face of the upper case 3. The operation panel 30 has various buttons such as a number button, a start button, a function operating button and so on, for various operations. The operation panel 30 has a display unit 31 of a liquid crystal (LCD) for displaying the various operation messages and so on of the image recording apparatus 1, if necessary.

In the upper case 3, a scanner device (or an image reading unit) 33 is provided on the back side of the operation panel 30. The scanner device 33 reads a facsimile document to be transmitted at the facsimile function time to a facsimile device on the other end and an image of a document to be copied at the copy function time. The scanner device 33 includes a flat-bed reading unit for reading the image of a document on a large-sized glass plate and a cover member 34 being turnable to cover the upper face of that flat-bet reading unit.

A line type contact image sensor (CIS) (not shown) as a photoelectric conversion element for reading the image face of a document placed in abutment against the glass plate is provided just below the glass plate in the flat-bed reading unit. The image sensor is capable of moving reciprocally along a guide axis extending in parallel with the moving direction (i.e., the main scanning direction or the Y-axis direction) of a later-described carriage.

Here, the cover member 34 is configured such that it can be opened and closed through a hinge on the back side (on the deep side of FIG. 1) of the image recording apparatus 1.

Configuration of the printer device (or the recording unit) will be described. A sheet feed cassette 5 is provided at the central portion in the main unit case 2 in the transverse direction. The paper sheet feed cassette 5 stacks sheets of paper P as a plurality of sheets of recorded media in substantially horizontal states on its bottom portion. The sheet feed cassette 5 is constituted such that it can be inserted into and extracted from an opening 2*a* formed in the front face of the main unit case 2. In this aspect, the sheet feed cassette 5 laminates (or stacks) the paper sheets P as the recorded media such that they have shorter sides (or widths) extended in the direction (i.e., the main scanning direction or the Y-axis direction) perpendicular to a sheet feed direction (i.e., the direction of arrow A). The paper sheets P may be cut into the A4 size, the letter size, the legal size or the post card size.

Figure 3:
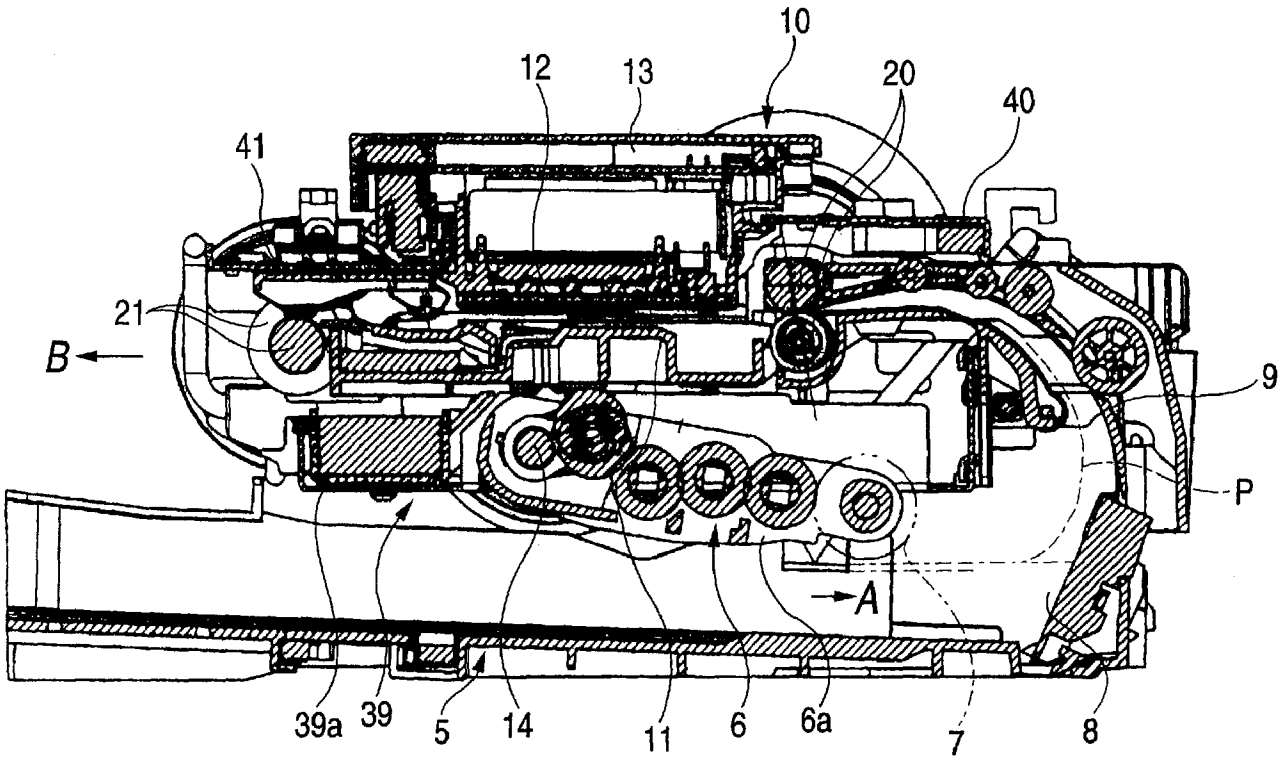
FIG. 3 is an enlarged sectional view taken along line III-III of FIG. 2.

A sloped separating plate 8 for separating the paper sheets is provided on the deep side of the sheet feed cassette 5 (i.e., on the right side of FIG. 3). The sloped separating plate 8 is formed into a bulging shape in a top plan view such that it projects on the central portion of the width direction (or the Y-axis direction) of the paper sheets P and retracts farther along toward the two right and left sides of the width direction of the paper sheets P. The sloped separating plate 8, which is provided at the central portion of the width direction of the paper sheets P, has a saw-toothed elastic separating pad (not shown) for abutting against the leading end edge of the paper sheets P to promote their separation during feeding.

A base end portion of a sheet feed arm 6*a* of feeding unit 6 is mounted on the side of the main unit case 2 such that it can be turned up and down. The sheet feed arm 6*a* has a sheet feed roller 7 at a leading end portion thereof. The rotating force from a drive shaft 14 is transmitted through a gear transmission mechanism provided in the sheet feed arm 6*a* to the paper sheet feed roller 7. By the sheet feed roller 7 and the elastic separating pad of the sloped separating plate 8, moreover, the paper sheets P, as stacked in the sheet feed cassette 5, are separated and conveyed one by one. The paper sheets P, separated to advance along the sheet feed direction (or the arrow A direction), are fed through a substantially U-turned transverse conveying path 9 to a recording unit 10 provided on an upper side (or at a higher position) than the sheet feed cassette 5.

Ink cartridges 26 for feeding ink to a color recording head 12 (refer to FIG. 4) are constituted such that they can be removably mounted from above through an upward opened housing portion 27 (refer to FIG. 2) in the main unit case 2. The ink cartridges 26 are stored with ink of individual colors such as black, cyan, magenta and yellow in this aspect. However, ink of more various colors may be contained. The ink is fed from the individual ink cartridges 26 to the recording head 12 by connecting flexible ink tubes 28.

Figure 2:
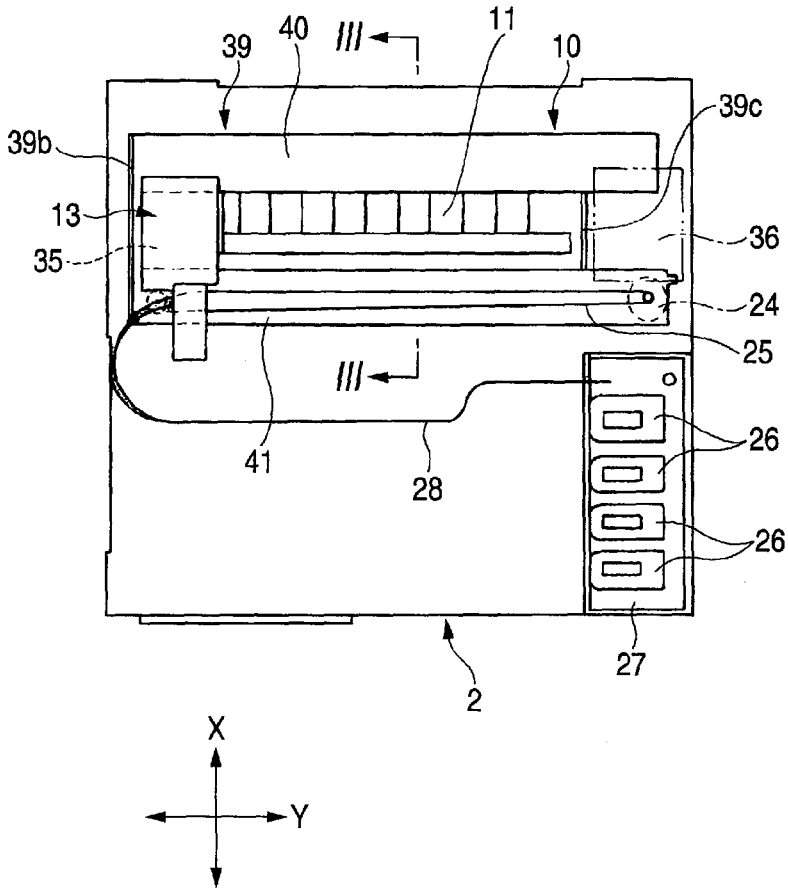
FIG. 2 is a top plan view of an image recording unit, from which an image reading device portion is removed.

As shown in FIGS. 2 and 3, the recording unit 10 includes a carriage 13 carrying the recording head 12, a plate-shaped platen 11 made of a synthetic resin, a CR (carriage) motor 24 for reciprocating the carriage 13, a timing belt 25 connected to the CR motor 24 and an engine frame 39 made of a metal sheet for supporting the foregoing components. The engine frame 39 is arranged on the back side of the main unit case 2 and over the sheet feed cassette 5. The engine frame 39 acting as the support frame is made of a metal and mounts a pair of guide plates 40 and 41 on the upper side of a main unit 39*a* having a box shape. As shown in FIGS. 2 and 3, the pair of guide plates 40 and 41 extend in the transverse direction (i.e., the main scanning direction or the Y-axis direction) of the main unit case 2 thereby to slidably support the carriage 13. The CR (carriage) motor 24 for driving the timing belt 25 is fixed on the lower face of the guide plate 41. The linear encoder (or encoder strip) (not shown) is provided on the guide plate 41. The liner encoder extends along its longitudinal direction (in the main scanning direction) thereby to detect the position of the carriage 13 in the main scanning direction (or in the Y-axis direction) and the moving direction of the carriage 13. The band-shaped linear encoder (or the encoder strip) is arranged such that the inspection face (or the face forming the slits arranged at a constant interval in the Y-axis direction) may extend along the perpendicular direction.

The drive shaft 14 and the sheet feed arm 6*a* of the feeding unit 6 are turnably borne in the main unit 39*a*. The main unit 39*a* has the plate-shaped platen 11, which confronts the lower face of the recording head 12 thereby to support the paper sheets P. The sheet feed arm 6*a* is always biased to turn downward by the biasing unit such as the torsion spring (not shown).

A resister roller (or conveying roller) pair 20 for feeding the paper sheets P to the lower face of the recording head 12 is arranged on the upstream side of the platen 11 in a conveying direction. A discharge roller pair 21 for conveying the recorded paper sheets P toward the sheet discharge unit (refer to the direction of arrow B in FIGS. 1, 2 and 4) is arranged on the downstream side of the platen 11 in the conveying direction. The sheet feed unit, which is composed of the sheet feed roller 7, the resister roller pair 20, the discharge roller pair 21 and so on, is driven by a reversible LF motor (not shown).

Outside of the width of the paper sheets P (or the shorter side of the paper sheets P) to be conveyed, an ink receiving unit 35 is arranged on one end side (at a portion close to a side plate 39*b* on the left side, as viewed in the feeding direction of the paper sheets P of the engine frame 39 in FIG. 2, or on the left side of the image recording area in the aspect). A maintenance unit 36 is arranged on the other side (at a portion close to the other side of a right side plate 39*c* in FIG. 2, or on the right side of the image recording area). As a result, the recording head 12 performs the ink discharge periodically, to prevent the clogging of the nozzle during the recording action, at the flushing position determined in the ink receiving unit 35 and the ink receiving unit 35 receives the discharged ink.

Figure 4:
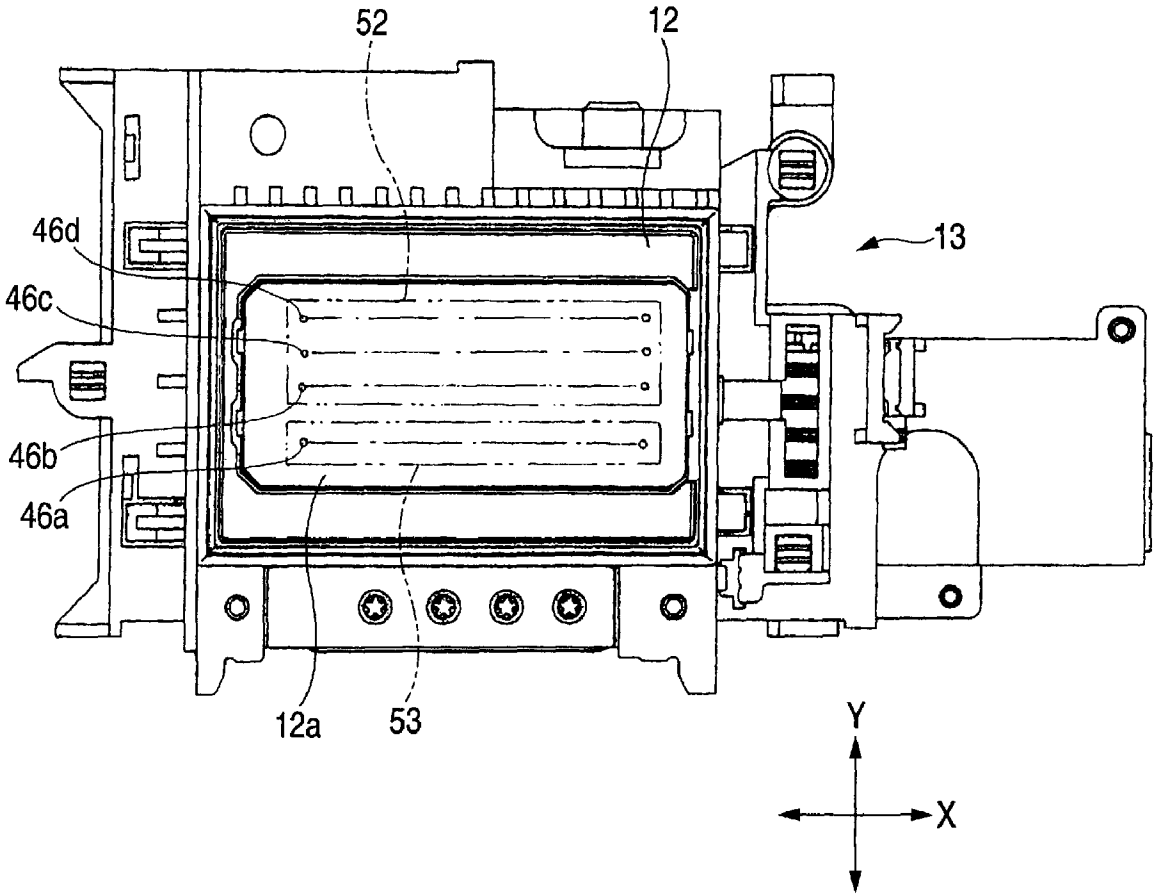
FIG. 4 is a bottom view of a carriage.

When the ink in the nozzle of the recording head 12 is evaporated or increased in viscosity at a low temperature, when air bubbles invade into the nozzle or the common ink chamber, or when a foreign substance sticks to a nozzle forming face 12*a* shown in FIG. 4, the recording head 12 cannot perform normal and steady recording action. Therefore, the maintenance unit 36 has a capping unit (or a suction recovery device) 45 (refer to FIG. 5) described later.

A cap member 50 of the capping unit 45 covers the nozzle forming face 12*a* of the recording head 12, and the LF motor (not shown) drives to actuate a suction pump 47 in order to perform a recovering operation for sucking the ink from the nozzles selectively or to remove the air bubbles from the buffer tanks (not shown) over the recording head 12 or the inside of the common ink chamber. When the carriage 13 moves transversely (or leftward in FIG. 2) from the maintenance unit 36 to the image recording area, the wiper member (not shown), which is arranged to move up and down on one side portion of the base member, wipes and cleans the nozzle forming face 12*a*.

FIG. 4 shows the lower face of the recording head 12 for multiple colors, in which a nozzle row 46*a* composed of a plurality of nozzles for discharging the black ink and nozzle rows 46*b*, 46*c* and 46*d* composed of a plurality of nozzles for discharging cyan, magenta and yellow ink are arranged at predetermined intervals in the main scanning direction (or the Y-axis direction). In this aspect, the nozzle row 46*a* for the black ink has 75 nozzles staggeredly arranged at a predetermined interval in the X-axis direction for one row (to have 150 nozzles in total). The nozzle rows 46*b*, 46*c* and 46*d* for the color ink each have 75 nozzles.

The recording head 12 has a common ink chamber (or a manifold) for temporarily reserving the ink fed from the ink tube 28 and individual ink passages communicating with the common ink chamber and extending to individual nozzles. In this aspect, a throttle portion, which has the highest flow resistance in the recording head 12, is arranged at the exit of the common ink chamber communicating with the individual ink passages. Moreover, the recording head 12 includes piezoelectric actuators forming part of the individual ink passages. When a piezoelectric actuator is deformed according to the image data inputted, the ink is discharged from the corresponding nozzle. In short, a series of passages leading from the ink feeding port through the common ink chamber, the throttle portion and the individual ink passages to the nozzles are formed.

Moreover, the black ink is made of a coloring material of a pigment group, and the color inks are made of coloring materials of a dye group.

FIGS. 6 to 10 show the capping unit (or the suction recovery device) 45 according to the first aspect of the invention. In this aspect, the cap holder 51 is connected through the lifting unit (not shown) to the base member (not shown) fixed on the maintenance unit 36 such that it can move up and down. As shown in FIGS. 8A-8C or the like, the capping unit 45 has the frame-shaped cap holder 51 made of a synthetic resin and opened upward, the cap member 50 made of a synthetic resin such as silicone rubber having a flexibility and a corrosion resistance to ink, and first and second cap chips 54 and 55 to be fitted in first and second housing recesses 52 and 53 of the cap member 50. The cap member 50 is removably attached to the upper face of the cap holder 51 (refer to FIGS. 6, 8A-8C and 9).

The first housing recess 52 is formed at a position to cover the portion of the aforementioned nozzle row 46*a* for the black ink, and the second housing recess 53 is formed at a position to cover the portions of the three nozzle rows 46*b*, 46*c* and 46*d* for the color ink, integrally. A peripheral rib 56 and a straight partitioning rib 57 are integrally provided to the cap member 50 (refer to FIGS. 6 and 7). The peripheral rib 56 is positioned in the outer periphery enclosing the entirety of the four nozzle rows 46*a*, 46*b*, 46*c* and 46*d* and has a substantially rectangular top plan view. The straight partitioning rib 57 substantially defines the first housing recess 52 and the second housing recess 53. Two ends of the partitioning rib 57 are contiguous to the inner side faces of the peripheral rib 56 (refer to FIGS. 7 and 8A-8C). The upper end portions of the peripheral rib 56 and the partitioning rib 57 are made small in the cross-sectional area so as to abut against the nozzle forming face 12*a* air-tightly when the surface side (on which the upper end portions of the peripheral rib 56 and the partitioning rib 57 project) of the cap member 50 is pushed onto the nozzle forming face 12*a*.

Engagement pawls 65*a* and 65*b*, which project obliquely downward from the upper end portions on the two right and left sides of the partitioning rib 57 into the first housing recess 52 and the second housing recess 63, are integrally provided to the partitioning rib 57. Engagement pawls 66*a* and 66*b*, which project obliquely downward from the upper end portions into the first housing recess 52 and the second housing recess 53, are integrally provided to the peripheral rib 56

Figure 9:
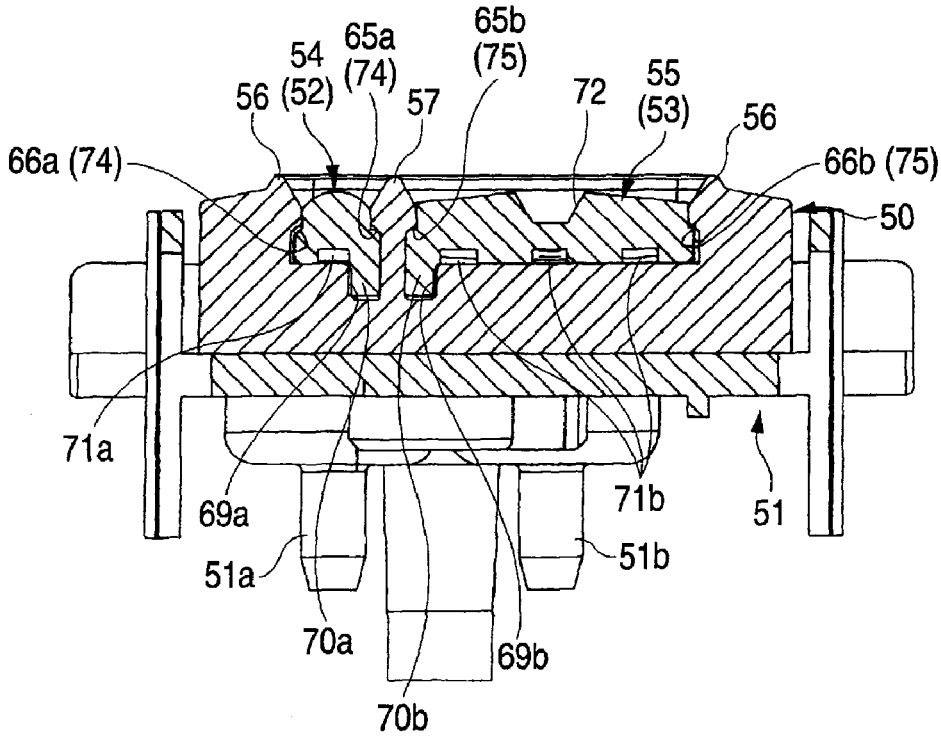
FIG. 9 is a sectional view taken along line IX-IX of FIG. 7.
Figure 10:
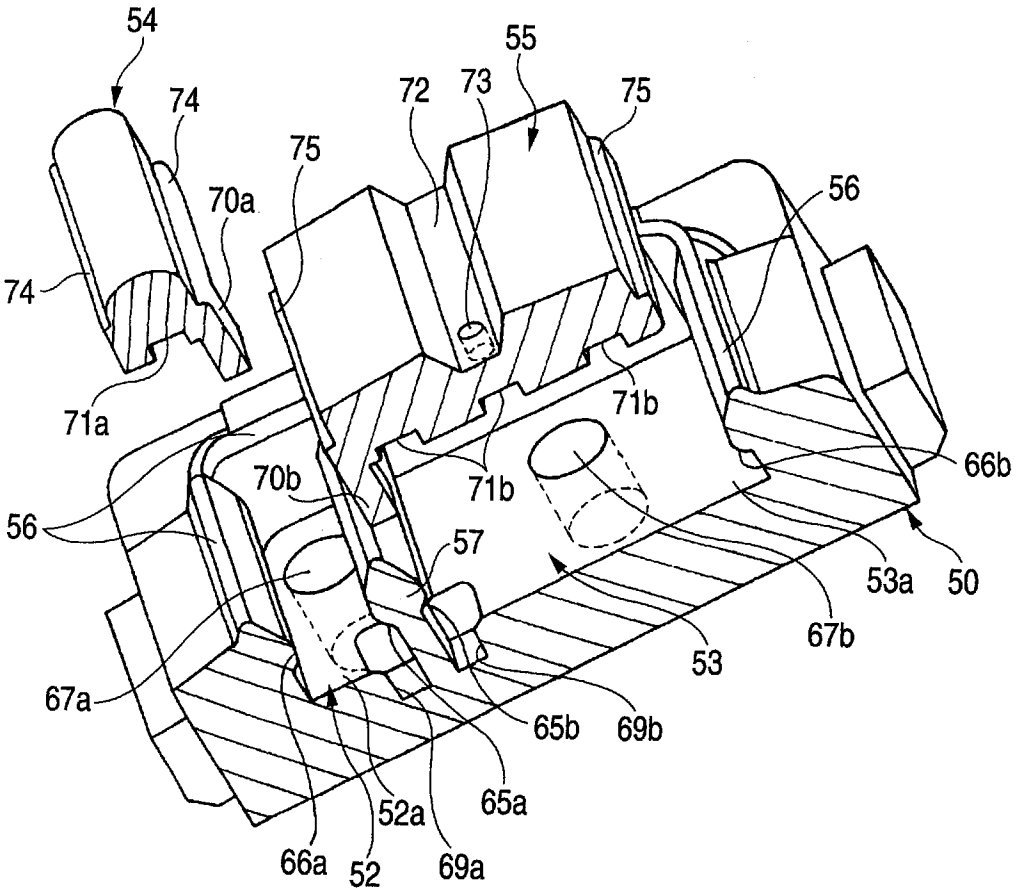
FIG. 10 is a partially cut-away perspective view of a cap member and a cap chip.
Figure 11:
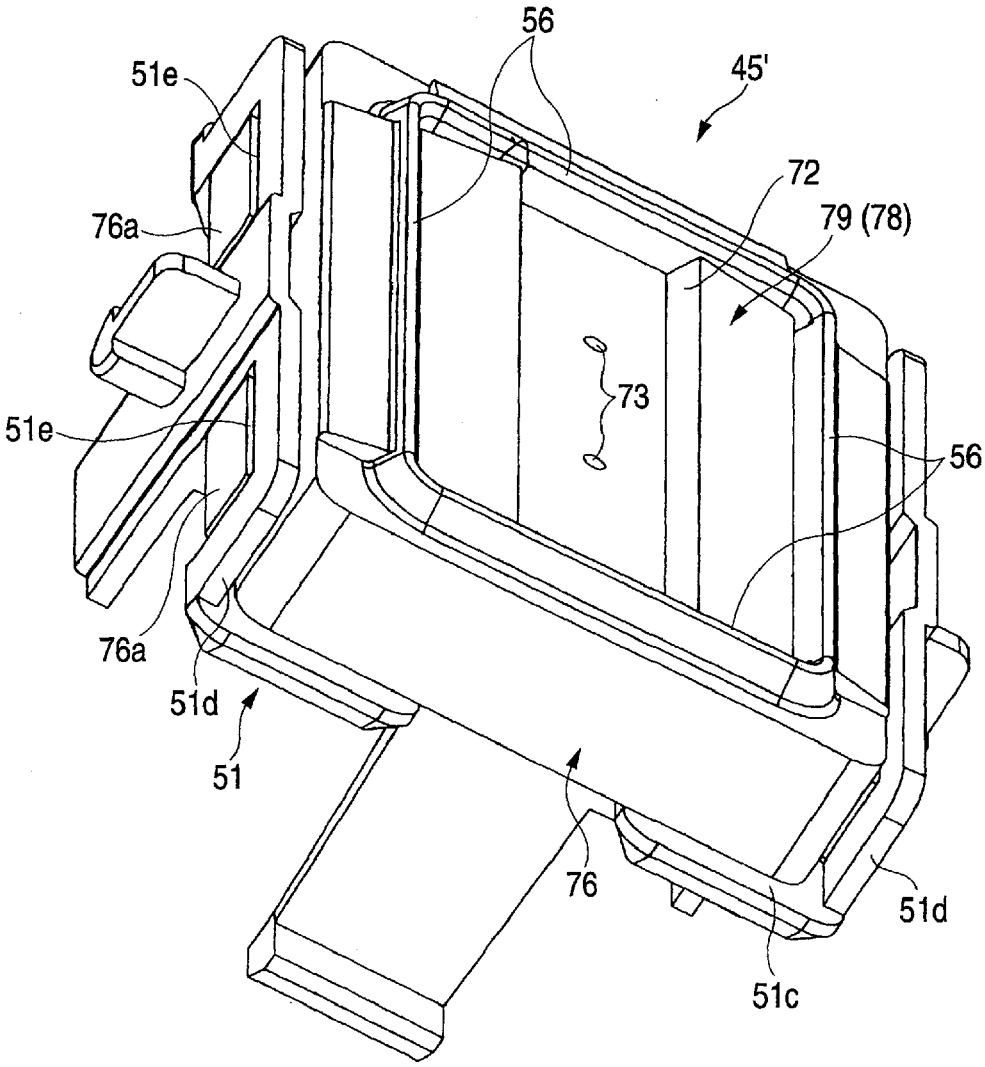
FIG. 11 is a perspective view of a capping unit according to a second aspect of the invention.

(refer to FIGS. 9 and 10). The engagement pawls 65*a* and 65*b* are formed over the whole length or the suitable length along the longer side of the partitioning rib 57. The engagement pawls 66*a* and 66*b* are formed over the whole length or the suitable length along the two opposite longer side faces of the peripheral rib 56.

Figure 8A:
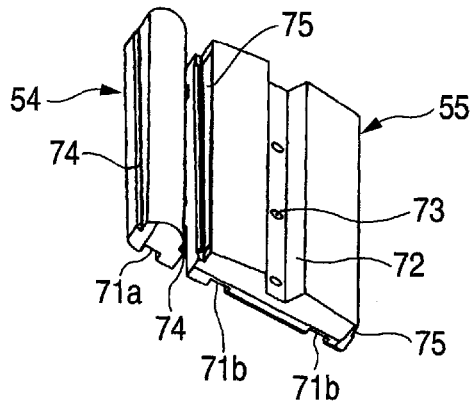
FIGS. 8A-8C are exploded perspective views of the parts of the capping unit.
Figure 8B:
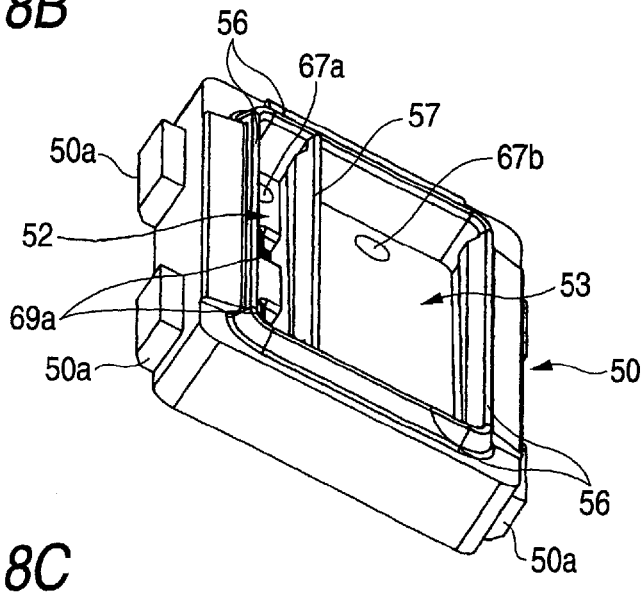
Figure 8C:
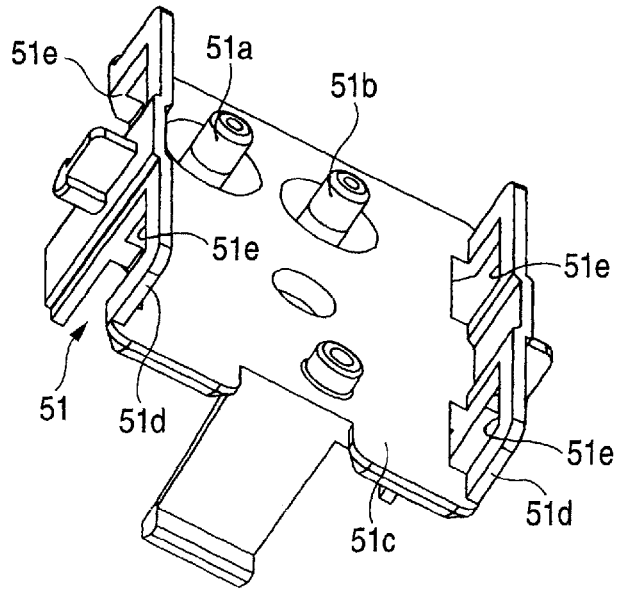

Ink discharge ports 67*a* and 67*b* are formed in the individual bottom portions 52*a* and 53*a* of the first housing recess 52 and the second housing recess 53 (refer to FIGS. 8A-8C). Ink discharge ports 67*a* and 67*b* have a round hole shape and are connected to ink discharge cylinders 51*a* and 51*b* erected from the bottom plate 51*c* of the cap holder 51. Engagement recesses 69*a* and 69*b*, which are adjacent or contiguous to the substantially vertical side faces of the partitioning rib 57, are formed in the individual bottom portions 52*a* and 53*a* of the first housing recess 52 and the second housing recess 53. Here, the word "contiguous" means that the engagement recesses 69*a* and 69*b* are formed to have one side face flush with a corresponding one of the substantially vertical side faces of the aforementioned partitioning rib 57.

Figure 7:
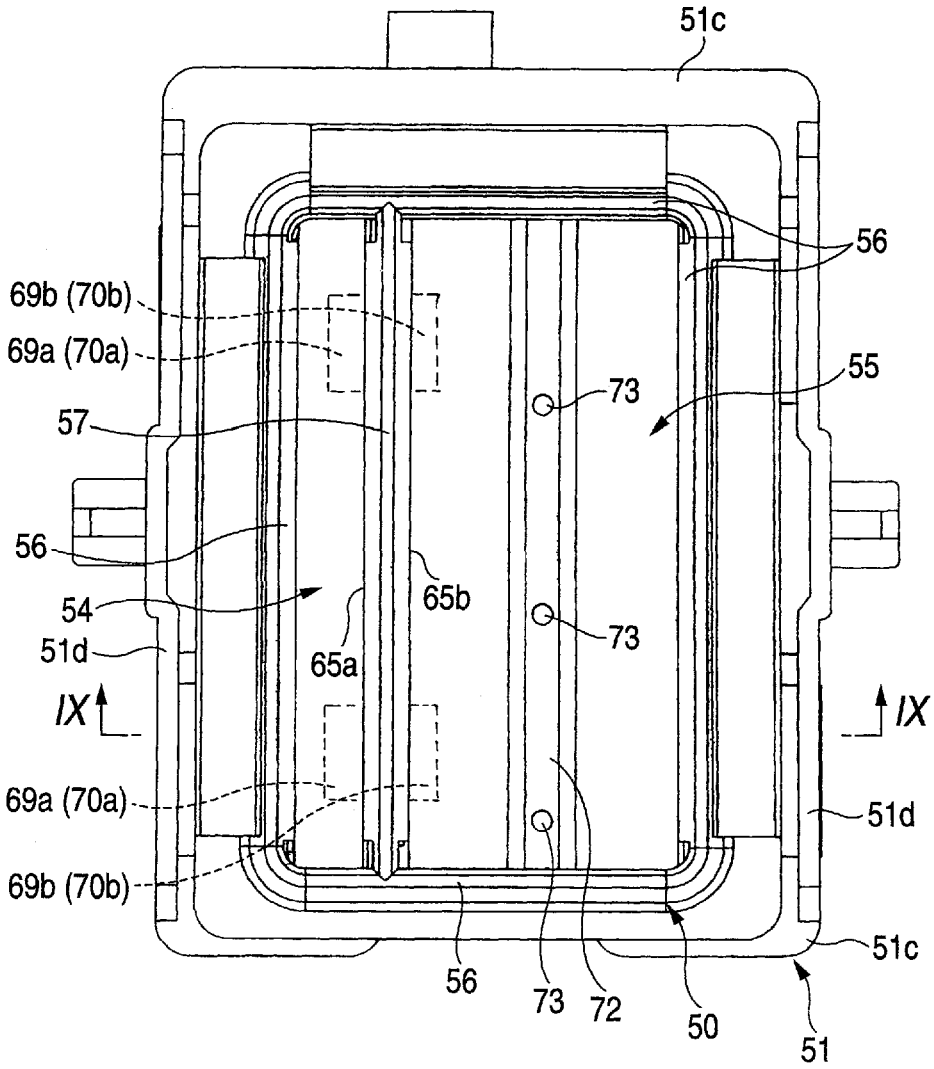
FIG. 7 is a top plan view of the capping unit.

In the first aspect, the aforementioned engagement recesses 69*a* and 69*b* are formed in a pair at positions confronting across the partitioning rib 57 in a top plan view (refer to FIG. 7). In this aspect, the individual engagement recesses 69*a* and 69*b* are formed in a top plan view in a rectangular shape, the longer sides of which extend in parallel with the side faces of the partitioning rib 57.

The first cap chip 54 and the second cap chip 55 are made of a synthetic resin having rigidity higher than the cap member 50 and less corroded by the ink. From the lower face sides of the two cap chips 54 and 55, engagement projections 70*a* and 70*b* are integrally projected to correspond to the positions, at which they are fitted in the aforementioned individual engagement recesses 69*a* and 69*b*. In this aspect, the engagement projections 70*a* and 70*b* are also formed in a top plan view in rectangular shapes, the longer sides of which extend in parallel with the longer sides (or the side faces of the partitioning rib 57) of the individual cap chips 54 and 55 (refer to FIGS. 7 and 10).

Recesses 71*a* and 71*b* are formed in the intermediate portions in the widthwise direction (or the shorter side direction) of the first cap chip 54 and the second cap chip 55. The recesses 71*a* and 71*b* have a long length extending along their individual longer sides (refer to FIGS. 8A to 10). In this aspect, three grooves 71*b* are juxtaposed in the second cap chip 55, and only one groove 71*a* is formed in the first cap chip 54. These grooves 71*a* and 71*b* and the bottom portions 52*a* and 53*a* of the first housing recess 52 and the second housing recess 53 form such suction passages of the ink inbetween as to communicate with the individual ink discharge ports 67*a* and 67*b*.

The upper face of the first cap chip 54 has a sectional contour formed into a bulging curve shape, higher at the intermediate portion in the shorter side direction (or the widthwise direction). On the other hand, the upper face of the second cap chip 55 has a sectional contour formed into a triangular roof shape, higher toward the intermediate portion in the shorter side direction (or the widthwise direction). An ink guide groove 72 is formed midway in the shorter side direction (or the widthwise direction) to extend in the whole length of the longer side (refer to FIGS. 6 to 10). Moreover, such ink guide holes 73 are drilled at a suitable interval along the longitudinal direction of the ink guide groove 72 as to communicate with the lower face of the second cap chip 55 from the midway portions of the ink guide groove 72 in the longitudinal direction, or desirably communicate with the arbitrary one of the grooves 71*b* (refer to FIGS. 6 to 8C).

Step portions 74 and 75, which retain the aforementioned individual engagement pawls 65*a*, 65*b*, 66*a* and 66*b*, are integrally formed on the two side faces along the longer sides of the first cap chip 54 and the second cap chip 55. Thus, it is possible to prevent the unprepared upward removal of the cap chips.

The peripheral rib 56 in the cap member 50 is formed to have a smaller angle of inclination on its outer peripheral side. Retaining projections 50*a*, which engage with retaining holes 51*e* formed in a pair of longitudinal side plates 51*d* of the cap holder 51, are integrally formed on the outer peripheral side face of the cap member 50 (refer to FIGS. 6 and 8A-8C).

Next, schematic configuration of an ink suction drive unit will be described with reference to FIG. 5. Flexible tubes 59*a* and 59*b* are connected at one side ends to the ink discharge cylinders 51*a* and 51*b* corresponding to the first housing recess 52 and the second housing recess 53 in the cap member 50. The other end of the tube 59*a* for the first housing recess 52 is connected to a port 60*a* in a rotary type four-port change-over valve 60. The other end of the tube 59*b* for the second housing recess 53 is connected to a port 60*b*. A flexible tube 61 connected to a port 60*c* is one component of the tube type suction pump 47 acting as a suction unit, and has its other end connected to or facing a waste ink absorber 62 capable of holding the waste ink. A flexible tube 63 connected to a port 60*d* is vented to the atmosphere. When a valve member 60*e* of the change-over valve 60 rotates a predetermined angle, it is possible to select a first phase (refer to the state of FIG. 5), in which only the port 60*a* and the port 60*c* communicate, a second phase, in which only the port 60*b* and the port 60*c* communicate, a third phase, in which only the port 60*d* and the port 60*c* communicate, and a fourth phase, in which all the aforementioned ports are closed (or shut off).

Figure 5:
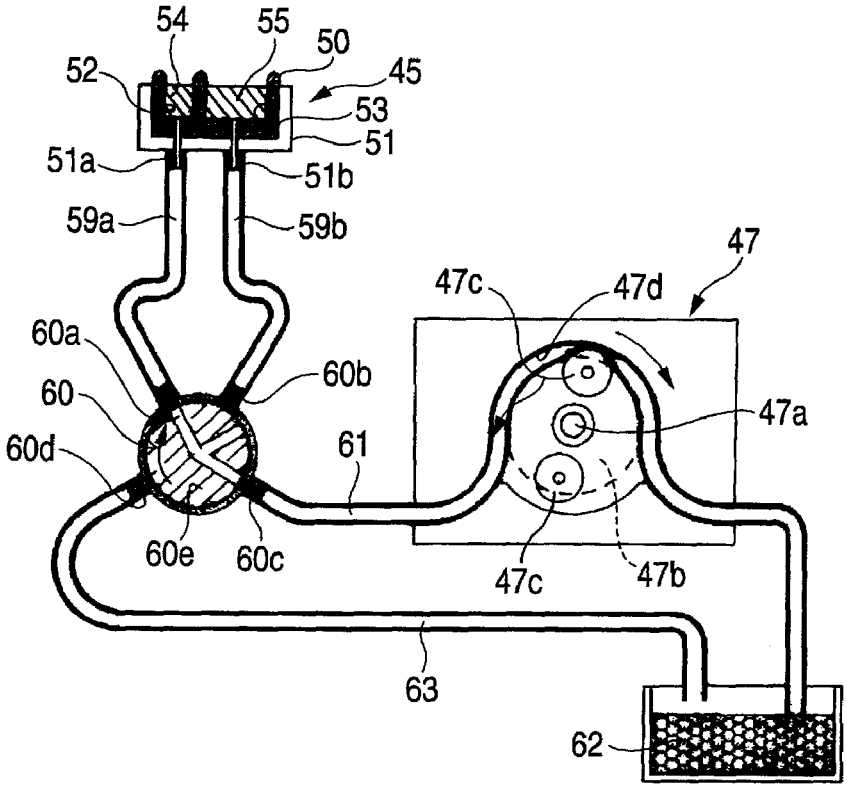
FIG. 5 is a diagram showing a suction unit and a change-over valve schematically.
Figure 6:
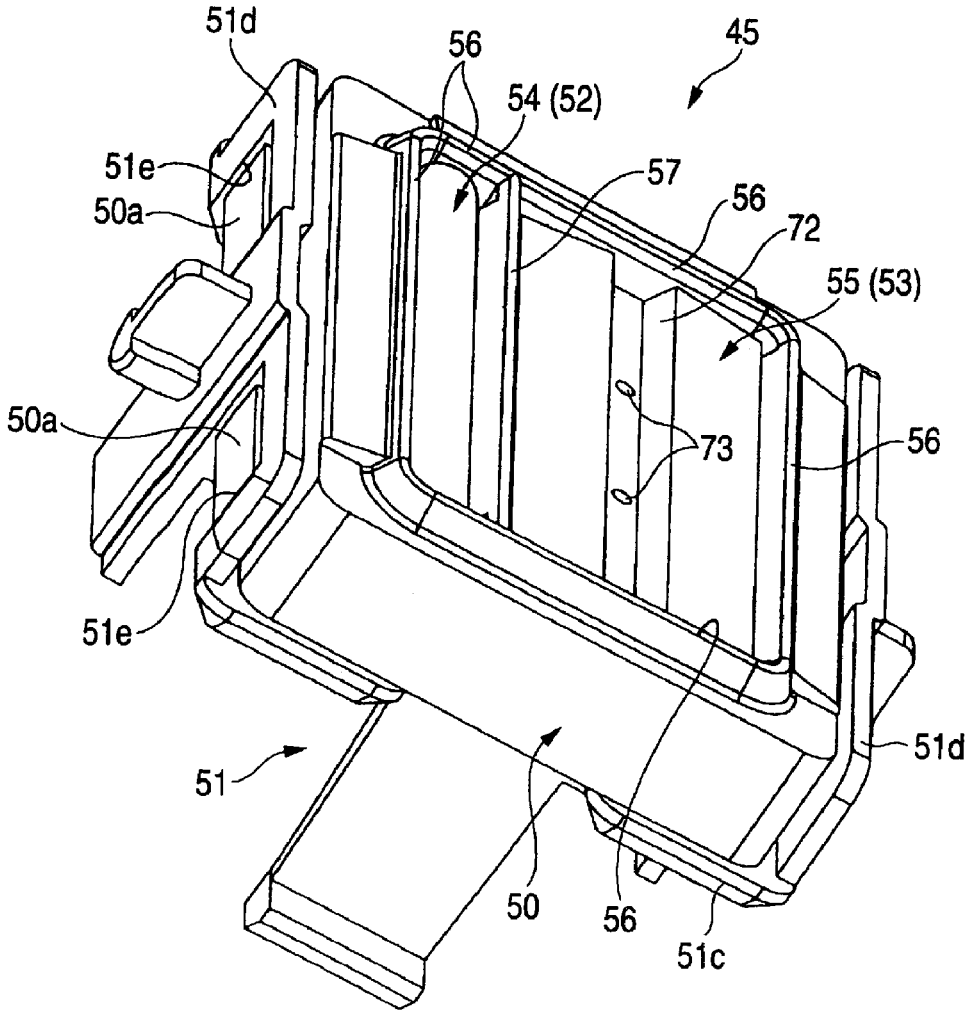
FIG. 6 is a perspective view of a capping unit according to a first aspect of the invention.

As shown in FIG. 5, the tube type suction pump 47 has a guide roller 47*b* rotating on a pump shaft 47*a*, a pressure roller 47*c* borne to rotate to the eccentric position of the guide roller 47*b*, and a regulating face 47*d* arranged on the substantially semicircular outer circumference of the guide roller 47*b* for crushing a portion of the tube 61 together with the pressure roller 47*c*. As the guide roller 47*b* and accordingly the pressure roller 47*c* rotate in the direction of the arrow in FIG. 5, the insides of the tubes 61, 59*a* and 59*b*, which are connected to the first housing recess 52 and the second housing recess 53 in close contact with the nozzle forming face 12*a*, are selectively evacuated.

With the constitution thus far described, when the first cap chip 54 is inserted into the first housing recess 52 of the cap member 50, the engagement projections 70*a* of the first cap chip 54 are firmly fitted in corresponding engagement recesses 69*a* of the first housing recess 52. Even if in the top plan view the size of the first cap chip 54 is slightly smaller than the size of the first housing recess 52, the first cap chip 54 can be positioned without any rattle in the first housing recess 52. If the second cap chip 55 is inserted into the second housing recess 53, the engagement projections 70*b* are likewise firmly fitted in corresponding engagement recesses 69*b*, and the second cap chip 55 can also be positioned without any rattle.

Moreover, the paired step portions 74 along the longer sides of the first cap chip 54 are fitted on the lower portions of the engagement pawls 66*a* and 65*a* on the inner circumference of the first housing recess 52. As a result, the first cap chip 54 hardly comes off or offsets upward with respect to the first housing recess 52, and the second cap chip 55 also hardly comes off with respect to the second housing recess 53. The first and second cap chips 54 and 55 are more rigid than the flexible cap member 50, and the engagement recesses 69*a* (or the engagement projections 70*a*) and the engagement recesses 69*b* (or the engagement projections 70*b*) are positioned to face each other in a top plan view of the cap member 50 across the paired confronting side faces of the partitioning rib 57. Accordingly, the aforementioned operational effects can be enhanced. The engagement pawls 65*a* and 65*b*, which prevent the individual cap chips 54 and 55 from coming off, are integrally formed at least on the side faces confronting the individual housing recesses 52 and 53 in the partitioning rib 57. The individual cap chips 54 and 55 are prevented from unpreparedly coming off upward or offsetting from the individual housing recesses 52 and 53. Accordingly, when the capping unit 45 seals the nozzle forming face 12*a*, the degree of flatness of the upper end edges of the peripheral rib 56 and the partitioning rib 57 with respect to the nozzle forming face 12*a* becomes excellent, and the sealing (or closing) effect is hard to deteriorate.

When the maintenance operations are executed, the capping unit 45 is raised, and the upper ends of the peripheral rib 56 and the partitioning rib 57 of the cap member 50 are pushed by a light force onto the nozzle forming face 12*a* of the recording head 12. The portion of the nozzle row 46*a* is covered with the portion of the first housing recess 52 (or the first cap chip 54) of the cap member 50, and the portions of the three nozzle rows 46*b*, 46*c* and 46*d* for the color ink are covered with the portion of the second housing recess 53 (or the second cap chip 55).

If a negative pressure is applied in the aforementioned state only to the inside of the first housing recess 52, the flexible peripheral rib 56 and partitioning rib 57 corresponding to the portion of the first housing recess 52 may be deformed to transversely fall toward the inside of the first housing recess 52 by the surrounding atmospheric pressure. However, the outer peripheral side faces as regulation portions (i.e., the entire side faces containing the upper substantially vertical side faces including the step portion 74 to abut against the engagement pawls 66*a* and 65*a* and the lower vertical side faces) of the first cap chip 54 abut over a wide range against the substantially entire vertical side faces of the peripheral rib 56 and the partitioning rib 57. As a result, it is possible to suppress the elastic transverse falls or deformations of the peripheral rib 56 and the partitioning rib 57 into the inside of the first housing recess 52. Specifically, the outer peripheral side faces of the highly rigid first cap chip 54 abut over a wide range against the flexible partitioning rib 57 of the small width size, and the first cap chip 54 neither chatters nor moves in the first housing recess 52. Accordingly, the transverse fall or the transverse deformation of the partitioning rib 57 can be effectively suppressed (or regulated).

Likewise, if the negative pressure is applied only to the inside of the second housing recess 53, the outer peripheral side faces, as regulation portion (i.e., the entire side faces containing the upper substantially vertical side faces including the step portions 75 to abut against the engagement pawls 66*b* and 65*b* and the lower vertical side faces) of the second cap chip 55 abut over a wide range against the substantially entire vertical side faces of the peripheral rib 56 and the partitioning rib 57. As a result, it is possible to suppress the elastic transverse falls or deformations of the peripheral rib 56 and the partitioning rib 57 into the inside of the second housing recess 53. Specifically, the outer peripheral side faces of the highly rigid second cap chip 55 abut over a wide range against the flexible partitioning rib 57 of small width size, and the second cap chip 55 neither chatters nor moves in the second housing recess 53. Accordingly, the transverse fall or the transverse deformation of the partitioning rib 57 can be effectively suppressed (or regulated).

If the transverse fall or the transverse deformation of the partitioning rib 57 is suppressed (or regulated), as described hereinbefore, the negative pressure applied to one housing recess can be prevented from being applied to the other housing recess. The ink suction from the nozzle row not requiring maintenance work is prevented thereby to reduce unnecessary ink consumption.

If the height sizes of the first cap chip 54 and the second cap chip 55 are set to predetermined proper values with respect to the vertical sizes of the first and second housing recesses 52 and 53, the first cap chip 54 can fill the vertical space in the first housing recess 52 within a proper range, and the second cap chip 55 can fill the vertical space in the second housing recess 53 within a proper range.

Even if the engagement projections 70*a* and 70*b* in the first cap chip 54 and the second cap chip 55 are projected downward such that they are fitted in the engagement recesses 69*a* and 69*b* of the individual housing recesses 52 and 53 of the cap member 50, the lower faces of the first cap chip 54 and the second cap chip 55 and the bottom faces of the first housing recess 52 and the second housing recess 53 can be brought into flat abutment by making the extending positions of the engagement projections 70*a* and 70*b* slightly smaller than the depths of the engagement recesses 69*a* and 69*b*. Moreover, the fitting positions of the engagement projections 70*a* and 70*b* in the engagement recesses 69*a* and 69*b* extend over a relatively large distance to the upper ends of the peripheral rib 56. As a result, the influences of the elastic deformations of the peripheral rib 56 and the partitioning rib 57 by the aforementioned fitting relations hardly affect up to the upper end edges of the partitioning rib 57. Thus, when the capping unit 45 seals the nozzle forming face 12*a*, the degree of flatness of the upper end edge of the partitioning rib 57 with respect to the nozzle forming face 12*a* becomes excellent.

If the negative pressure is applied selectively to the insides of the first and second housing recesses 52 and 53, the ink, as sucked from the corresponding nozzles 46*a* (46*b*, 46*c* or 46*d*) of the recording head 12 is discharged to the upper face of the first cap chip 54 (or the second cap chip 55). The black ink migrates to the bottom side of the first housing recess 52 through the clearance between the outer periphery of the first cap chip 54 and the inner side faces of the first housing recess 52 and is sucked along the long groove 71*a* into the ink discharge port 67*a*. Accordingly, the black ink can be disposed of through the tubes 59*a* and 61. On the other hand, the color ink can be sucked and disposed of all together from the three nozzle rows 46*b*, 46*c* and 46*d*. If the cap chip 54 (55) has a large area or length in a top plan view, the large quantities of ink, which spread over the wide ranges of the bottom portions 52*a* and 53*a* of the housing recesses 52 and 53, can be efficiently and promptly discharged to the small number of discharge ports 67*a* and 67*b* by forming the grooves 71*a* and 71*b*.

A capping unit (or the suction recovery device) 45' according to a second aspect of the invention is shown in FIG. 11 to FIG. 14. In this second aspect, the cap holder 51 having a substantially same configuration as that of the first aspect is connected to the base member (not shown), which is fixed on the maintenance unit 36. The cap holder 51 is capable of moving up and down through the lifting unit (not shown). As shown in FIGS. 8A to 14 or the like, the capping unit 45' has the frame-shaped cap holder 51, a cap member 76 and one cap chip 79. The cap holder 51 is made of a synthetic resin and opened upward. The cap member 76 is made of a synthetic resin such as silicone rubber having a flexibility and a corrosion resistance to ink. The cap chip 79 is fitted in one housing recess 78 of the cap member 76. The cap member 76 is removably attached to the upper face of the cap holder 51 (refer to FIGS. 13A-13C and 14).

The housing recess 78 is formed at a position to cover the portions of the aforementioned nozzle row 46*a* for the black ink and the portions of the three nozzle rows 46*b*, 46*c* and 46*d* for the color ink, collectively. The peripheral rib 56 (the same as that of the first aspect), which is positioned in the outer periphery enclosing the entirety of the four nozzle rows 46*a*, 46*b*, 46*c* and 46*d* and has a substantially rectangular top plan view, is integrally formed with the cap member 76 (refer to FIGS. 11 to 14). The cross-sectional area of such upper end portion of the peripheral rib 56 abutting against the nozzle forming face 12*a* is made small. Thus, it can maintain air-tightness when the surface side (on which the upper end portion of the peripheral rib 56 projects) of the cap member 76 is pushed onto the nozzle forming face 12*a*.

As in the first aspect, the engagement pawls 66*a* and 66*b*, which project obliquely downward from the upper end portion into the housing recess 78, are integrally provided with the peripheral rib 56. The engagement pawls 66*a* and 66*b* are formed at positions parallel to the nozzle row 46*a* (refer to FIGS. 12 and 13A-13C).

Ink discharge ports 67*a* and 67*b* are formed in the bottom portion 78*a* of the housing recess 78 (refer to FIG. 8A-8C). The ink discharge ports 67*a* and 67*b* have a round hole shape and are connected to ink discharge cylinders 51*a* and 51*b* erected from the bottom plate 51*c* of the cap holder 51. Engagement recesses 69*a* and 69*b*, which are adjacent or contiguous to the paired substantially vertical side faces of the peripheral rib 56 in parallel with the nozzle row 46*a*, are formed in the bottom portion 78*a* of the housing recess 78. Here, the word "contiguous" means that the engagement recesses 69*a* and 69*b* are formed to have one side face flush with a corresponding one of the substantially vertical side faces of the aforementioned peripheral rib 56.

Figure 12:
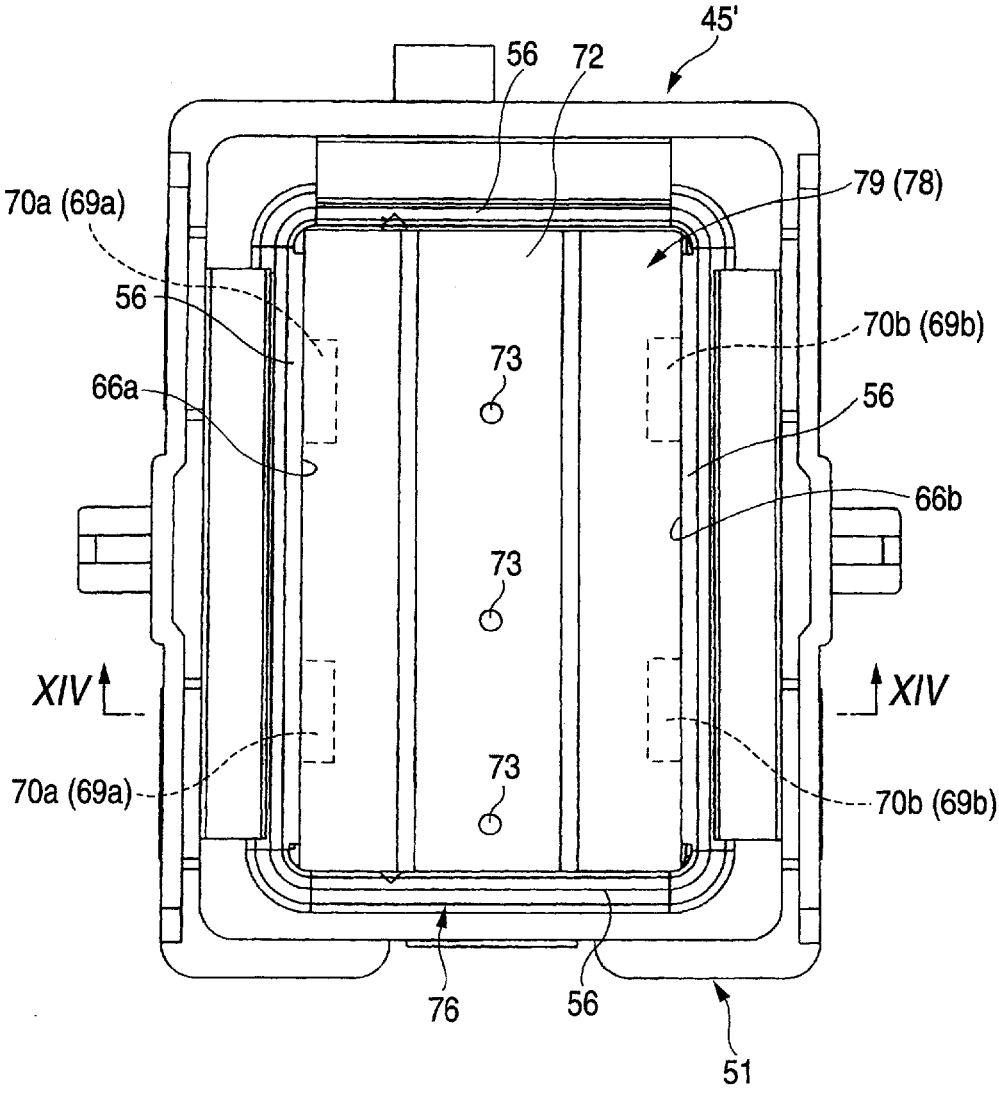
FIG. 12 is a top plan view of the capping unit.
Figure 13A:
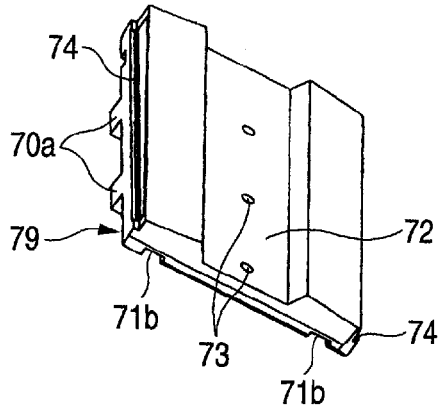
FIGS. 13A-13C are exploded perspective views of the parts of the capping unit.
Figure 13B:
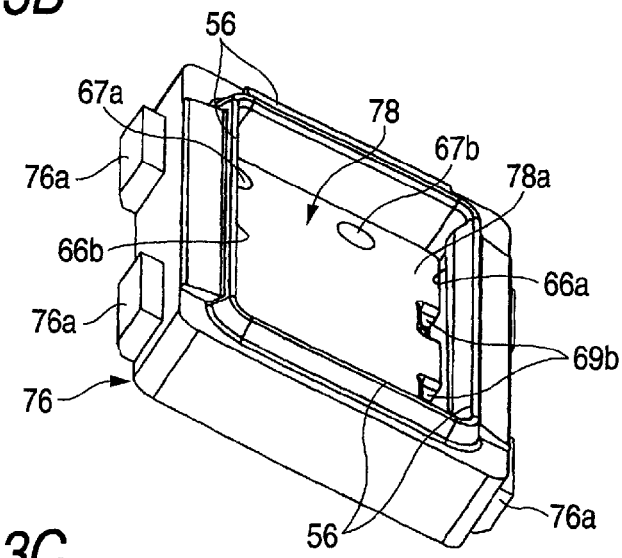
Figure 13C:
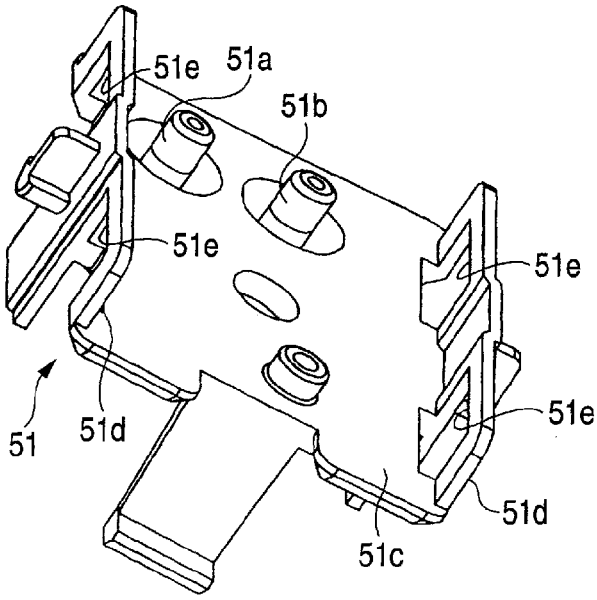
Figure 14:
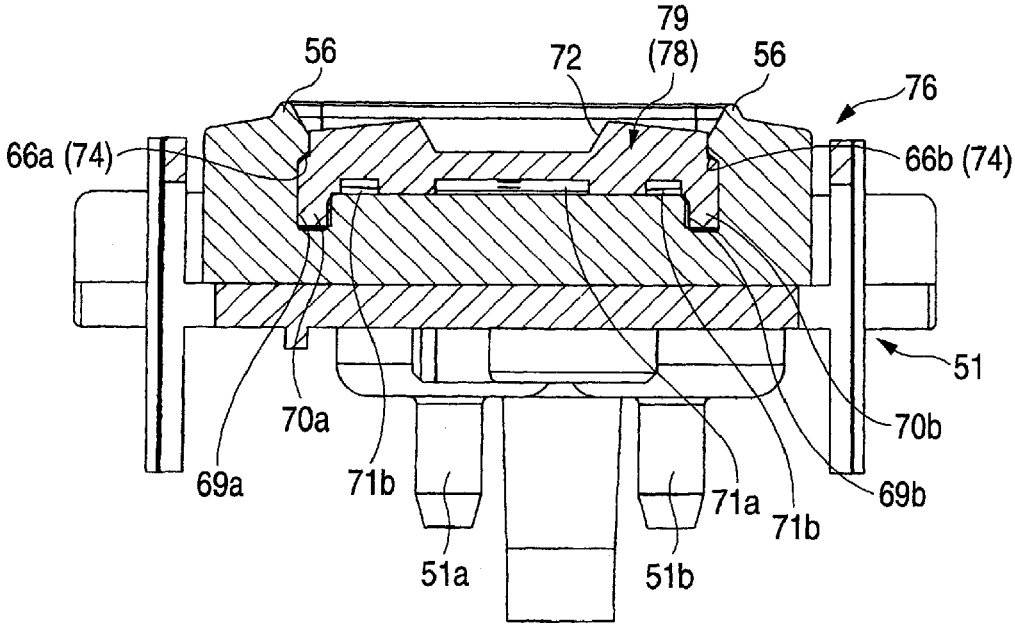
FIG. 14 is a sectional view taken along line XIV-XIV of FIG. 12.

In the second aspect, two engagement recesses 69*a* are formed at one of the paired side faces of the peripheral rib 56 at positions confronting, in a top plan view, two engagement recesses 69*b* formed at the other (refer to FIG. 12). In this aspect, the individual engagement recesses 69*a* and 69*b* are formed in a top plan view into a rectangular shape, the longer sides of which extend in parallel with the side faces of the peripheral rib 56.

The cap chip 79 is made of a synthetic resin more rigid than the cap member 76 and less corroded by the ink. From the lower face side of the cap chip 79, engagement projections 70*a* and 70*b* are integrally projected to correspond to the positions, at which they are fitted in the aforementioned individual engagement recesses 69*a* and 69*b*. In the second aspect, the engagement projections 70*a* and 70*b* are also formed in a top plan view into rectangular shapes, the longer sides of which extend in parallel with the longer sides (or the side faces of the peripheral rib 56) of the cap chip 79 (refer to FIGS. 12 and 14).

As in the first aspect, a plurality of grooves 71*a* and 71*b* are formed at the intermediate portions in the widthwise direction (or the shorter side direction) of the cap chip 79. The grooves 71*a* and 71*b* have a long length extending along the longer sides of the cap chip 79 (refer to FIGS. 13A-13C and 14). In the second aspect, these grooves 71*a* and 71*b* and the bottom portion 78*a* of the housing recess 78 form suction passages of the ink inbetween in order to communicate with the individual ink discharge ports 67*a* and 67*b*.

The upper face of the cap chip 79 has a sectional contour formed into a triangular roof shape that is higher toward the intermediate portion in the shorter side direction (or the widthwise direction). An ink guide groove 72 is formed midway in the shorter side direction (or the widthwise direction) to extend the whole length of the longer side (refer to FIGS. 11 to 14). Moreover, such ink guide holes 73 are drilled at a suitable interval along the longitudinal direction of the ink guide groove 72 as to communicate with the lower face of the cap chip 79 from the midway portion of the ink guide groove 72 in the longitudinal direction, desirably communicate with the grooves 71*a* (refer to FIGS. 11 to 13C).

The step portions 74, which retain the aforementioned individual engagement pawls 66*a* and 66*b* in order to prevent unprepared upward removal of the cap chips, is formed on the two side faces along the longer sides of the cap chip 79. The peripheral rib 56 in the cap member 76 is formed to have a smaller angle of inclination on its outer peripheral side. Retaining projections 76*a*, which engage with the retaining holes 51*e* formed in a pair of longitudinal side plates 51*d* of the cap holder 51, are integrally formed on the outer peripheral side face of the cap member 76 (refer to FIGS. 11 and 13A-13C).

If the cap chip 79 is inserted into the housing recess 78 of the cap member 76, the engagement projections 70*a* and 70*b* of the cap chip 79 are firmly fitted in the individual engagement recesses 69*a* and 69*b* of the housing recess 78. Even if in the top plan view the size of the cap chip 79 is slightly smaller than the size of the housing recess 78, the cap chip 79 can be positioned without any rattle in the housing recess 78.

The paired step portions 74 along the longer side of the cap chip 79 are fitted on the lower portions of the engagement pawls 66*a* and 65*a* on the inner circumference of the housing recess 78. As a result, the cap chip 79 hardly comes off or offsets upward with respect to the housing recess 78.

The cap chip 79 is more rigid than the flexible cap member 76. Further, the engagement recesses 69*a* and 69*b* (or the engagement projections 70*a* and 70*b*) are positioned to face each other in a top plan view of the cap member 76 at the paired confronting side faces of the peripheral rib 56. Accordingly, the operational effects can be enhanced.

The engagement pawls 65*a* and 65*b*, which prevent the cap chip 79 from coming off, are integrally formed on the side faces confronting the housing recess 78 in the peripheral rib 56. The cap chip 79 hardly unpreparedly comes out upward or offsets from the housing recess 78. Thus, the degree of flatness of the upper end edges of the peripheral rib 56 with respect to the nozzle forming face 12*a* becomes excellent, and the sealing (or closing) properties are hard to deteriorate.

When executing the maintenance operations, the capping unit 45 is raised, and the upper end of the peripheral rib 56 of the cap member 76 is pushed by a light force onto the nozzle forming face 12*a* of the recording head 12. The portions of all the nozzle rows 46*a*, 46*b*, 46*c* and 46*d* are covered with the portion of the housing recess 78 (or the cap chip 79).

If a negative pressure is applied to the inside of the housing recess 78, the flexible peripheral rib 56 may be deformed to transversely fall toward the inside of the housing recess 78 by the surrounding atmospheric pressure. However, the outer peripheral side faces as regulation portions (i.e., the entire side faces containing the upper substantially vertical side faces including the step portion 74 to abut against the engagement pawls 66*a* and 66*b* and the lower vertical side faces) of the cap chip 79 abuts over a wide range against the substantially entire vertical side faces of the peripheral rib 56. As a result, it is possible to suppress (or regulate) the elastic transverse falls or deformations of the peripheral rib 56 into the inside of the housing recess 78.

The present invention should not be limited to the aspects having been explained in the foregoing description with reference to the accompanying drawings, but could be embodied in various manners within the scope not departing from the gist thereof.

In the first aspect, the engagement recesses 69*a* and 69*b* corresponding to the engagement projections 70*a* and 70*b* may be formed only as a pair of recesses or three or more pair of recesses at the confronting positions across the partitioning rib 57. Alternatively, they may be only a pair of recesses extending along the longer side of the partitioning rib 57.

The first cap chip 54 and the second cap chip 55 can be completely prevented from rattling by setting the top plan shapes of the engagement projections 70*a* and 70*b* to be slightly larger than those of the engagement recesses 69*a* and 69*b* and by press-fitting the former to the latter. This may also be adopted in the second aspect.

The partitioning rib 57 may provide partitions for the individual nozzle rows and may be two or three in number.

What is claimed is:

1. An image recording apparatus comprising:

a recording head having a plurality of nozzles which eject ink; and a capping unit which seals a nozzle forming face of the recording head and sucks the ink from the nozzles, wherein the capping unit includes:

a cap member having a plurality of housing recesses which are partitioned from each other for ink suction from a corresponding one of a plurality of groups of the nozzles; and cap chips housed in the respective housing recesses, wherein the cap member includes:

discharge ports which discharge the ink sucked into the respective housing recesses;

a peripheral rib which is positioned at an outer peripheral portion enclosing the plurality of housing recesses; and a partitioning rib defining the housing recesses, wherein opposite ends of the partitioning rib are connected to the peripheral rib, and wherein each of the housing recesses has a bottom face for receiving a corresponding one of the cap chips, and an engagement recess recessed from the bottom face in a direction away from a top end of the partitioning rib, the partitioning rib extends to a bottom of the engagement recess of each of the housing recesses, and each of the cap chips includes an engagement projection which is fitted in a corresponding one of the engagement recesses such that the engagement projection abuts against a corresponding one of opposite side faces of the partitioning rib.

2. The image recording apparatus according to claim 1, wherein the engagement recess of one of the housing recesses and the engagement recess of another one of the housing recesses are disposed at positions to confront each other across the partitioning rib.

3. The image recording apparatus according to claim 1, wherein engagement pawls are formed on the opposite side faces of the partitioning rib, which confront the respective housing recesses, to prevent the cap chips from coming off.

4. The image recording apparatus according to claim 3, wherein each of the cap chips has a step portion which is engaged with a corresponding one of the engagement pawls of the partitioning rib.

5. The image recording apparatus according to claim 1, wherein suction passages to communicate with the respective discharge ports are formed between lower faces of the cap chips and the bottom faces of the housing recesses.

6. An image recording apparatus comprising:

a recording head having a plurality of nozzles which eject ink; and a capping unit which seals a nozzle forming face of the recording head and sucks the ink from the nozzles, wherein the capping unit includes:

a cap member having a housing recess which collectively sucks the ink from a plurality of groups of the nozzles; and a cap chip housed in the housing recess;

wherein the cap member includes:

a discharge port which discharges the ink sucked into the housing recess, and a peripheral rib which is positioned at an outer peripheral portion enclosing the housing recess; and wherein the housing recess has a bottom face for receiving the cap chip, and engagement recesses recessed from the bottom face in a direction away from a top end of the peripheral rib, the peripheral rib extends to a bottom of each of the engagement recesses of the housing recess, and the cap chip includes engagement projections which are fitted in the engagement recesses respectively such that each of the engagement projections abuts against a corresponding one of opposite inner side faces of the peripheral rib.

7. The image recording apparatus according to claim 6, wherein one of the engagement recesses and another one of the engagement recesses are disposed at positions to confront each other in an opposing direction of the opposite inner side faces of the peripheral rib.

8. The image recording apparatus according to claim 6, wherein engagement pawls are formed on the opposite inner side faces of the peripheral rib, which confront the housing recess, to prevent the cap chip from coming off.

9. The image recording apparatus according to claim 8, wherein the cap chip has step portions which are engaged with the engagement pawls of the peripheral rib.

10. The image recording apparatus according to claim 6, wherein a suction passage to communicate with the discharge port is formed between a lower face of the cap chip and the bottom face of the housing recess.

* * * * *